US006851137B2

(12) United States Patent
Hennessy

(10) Patent No.: US 6,851,137 B2
(45) Date of Patent: Feb. 8, 2005

(54) FURLING SHEATH FOR HAMMOCK

(76) Inventor: Thomas Hennessy, 637 Southwind Road, Galiano Island BC (CA), V0N 1P0

( * ) Notice: Subject to any disclaimer, the term of this patent is extended or adjusted under 35 U.S.C. 154(b) by 0 days.

(21) Appl. No.: 10/199,493

(22) Filed: Jul. 22, 2002

(65) Prior Publication Data

US 2003/0074734 A1 Apr. 24, 2003

Related U.S. Application Data

(60) Continuation-in-part of application No. 09/770,670, filed on Jan. 29, 2001, now Pat. No. 6,421,851, which is a division of application No. 09/262,448, filed on Mar. 4, 1999, now Pat. No. 6,185,763.

(51) Int. Cl.[7] ..... A47F 1/06

(52) U.S. Cl. ..... 5/120; 5/122; 5/130

(58) Field of Search ..... 5/120–122, 128, 5/130

(56) References Cited

U.S. PATENT DOCUMENTS

| | | | | | |
|---|---|---|---|---|---|
| 342,668 | A | * | 5/1886 | Woodbury | 5/122 |
| 4,682,447 | A | * | 7/1987 | Osborn | 52/3 |
| 5,113,537 | A | * | 5/1992 | Turk | 5/121 |
| 5,857,231 | A | * | 1/1999 | Wade | 5/120 |
| 6,185,763 | B1 | * | 2/2001 | Hennessy | 5/120 |

* cited by examiner

*Primary Examiner*—Teri Pham Luu
*Assistant Examiner*—Fredrick Conley

(57) ABSTRACT

A hammock is provided with a pair of tubular sheaths which can be drawn toward one another to furl the hammock while it is suspended from trees.

9 Claims, 5 Drawing Sheets

FURLING SHEATH FOR HAMMOCK

This application is a continuation-in-part of application Ser. No. 09/770,670, filed Jan. 29, 2001 now U.S. Pat. No. 6,421,851, which was a division of application Ser. No. 09/262,448, filed Mar. 4, 1999 now U.S. Pat. No. 6,185,763.

FIELD OF THE INVENTION

This invention relates to hammocks.

BACKGROUND OF THE INVENTION

For camping and other recreational activities, different hammocks have been developed to provide shelter from insects, ground dwelling creatures and inclement weather. Being suspended above the ground, hammocks provide a more comfortable, dry, warm and clean surface than do tents.

In my U.S. Pat. No. 6,185,763, I described a hammock the bed of which is made from a substantially rectangular piece of material. That bed is slit at one end to allow one to enter the bed from below. Tension on the material keeps the slit closed while a person is lying in the bed. The present invention is designed for use with a hammock of the type described in my prior patent, and for other types of hammocks which lack rigid elements that would prevent the hammock from being furled or collapsed by lengthwise folding or gathering.

SUMMARY OF THE INVENTION

The present invention provides a sheath which can be quickly drawn over the hammock from either end, even while the hammock is suspended from trees. Preferably two such sheaths are provided, each attached to a respective end of the bed of the hammock, so that they may be drawn toward one another, meeting at the midpoint of the hammock, whereupon they fully enclose the bed material. The diameter of the sheath is made as small as possible, to minimize the volume of the stowed hammock, and the sheath is preferably tapered. The free end of each sheath forms a mouth which is reinforced with a stiffener to facilitate drawing the sheath over the hammock bed material.

Hammocks are easier to keep clean than tents, because they do not touch the ground in use. An advantage of this invention is that it enables one to furl or collapse a hammock without having to lay the hammock out on the ground, and thus avoids getting dirt and leaves into the hammock while rolling it up.

BRIEF DESCRIPTION OF THE DRAWINGS

In the accompanying drawings.

DETAILED DESCRIPTION OF THE PREFERRED EMBODIMENT

Figure 1:
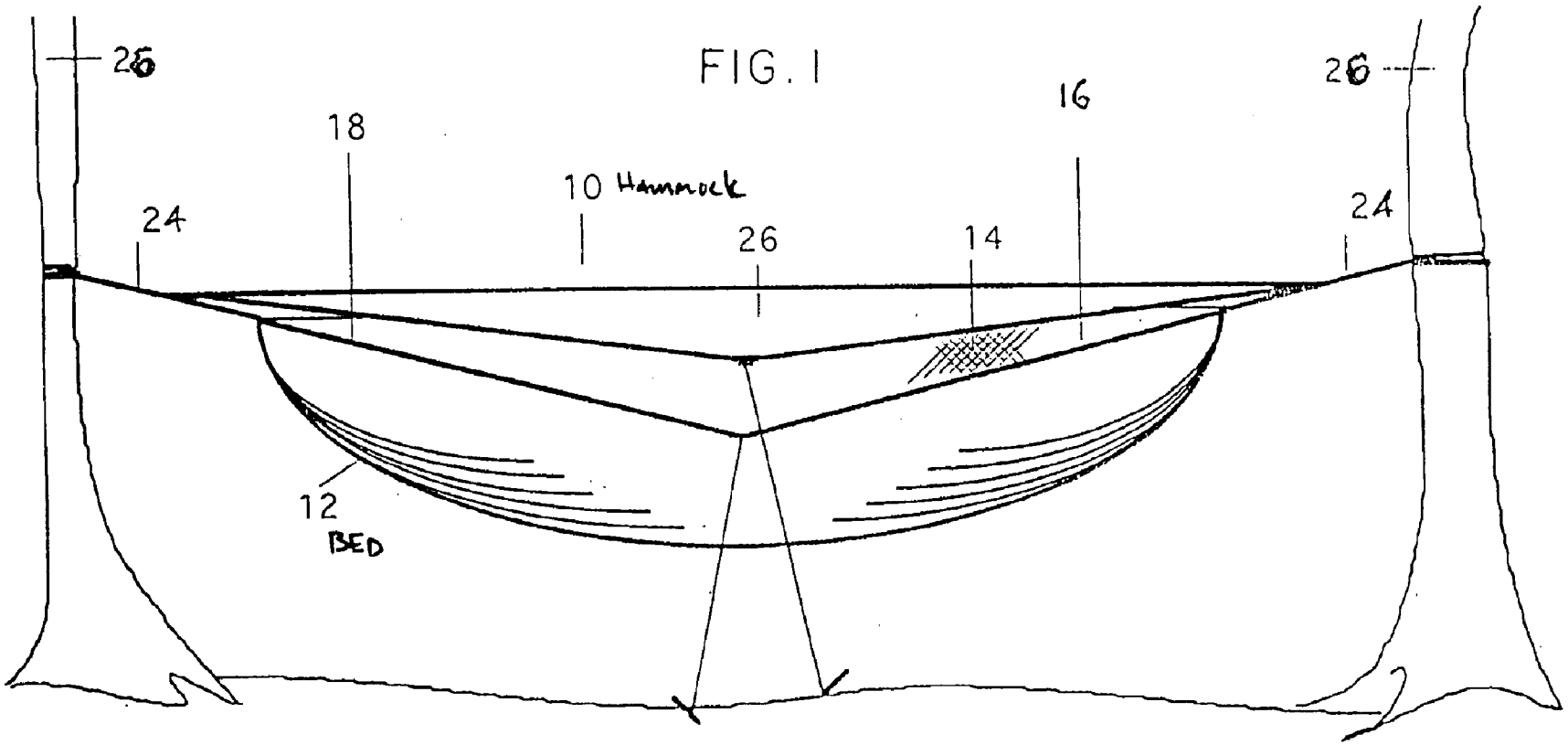
FIG. 1 is a side elevation of a hammock comprising a bed, an insect net and a canopy.

As shown in FIG. 1, a hammock 10 comprises a bed 12 and an insect net 14, which is located above bed 12 and is attached along its edges 16 to longitudinal sides 18 of the bed 12. A rain fly 20 may be placed above the hammock. The ends 22 of the bed 12 are connected by suspending ropes 24 to spaced anchors 26 such as trees.

The bed 12, which is dimensioned to provide accommodation for one or more persons, is made from a sheet of flexible, breathable material. It must be of sufficient strength and resilience to withstand an appropriate load and repeated use under varying conditions.

Figure 2:
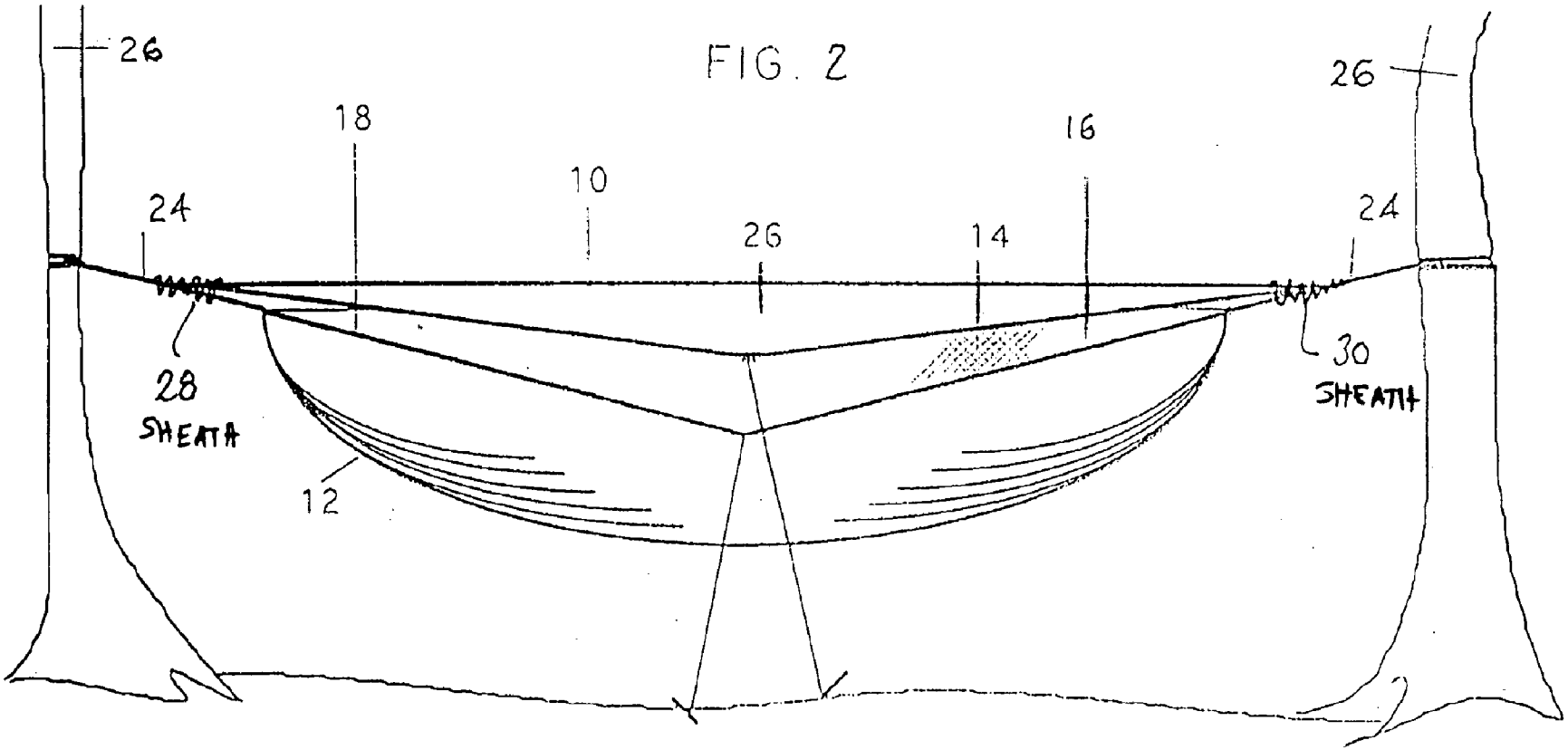
FIG. 2 shows the hammock, with a pair of sheaths at either end, the sheaths being retracted.

Two identical sheaths 28, 30 are shown in FIG. 2, retracted in bunched form, one at either end of the bed, around the suspending rope. In this configuration, the sheaths are out of the way, where they do not interfere with use of the bed.

Figure 3:
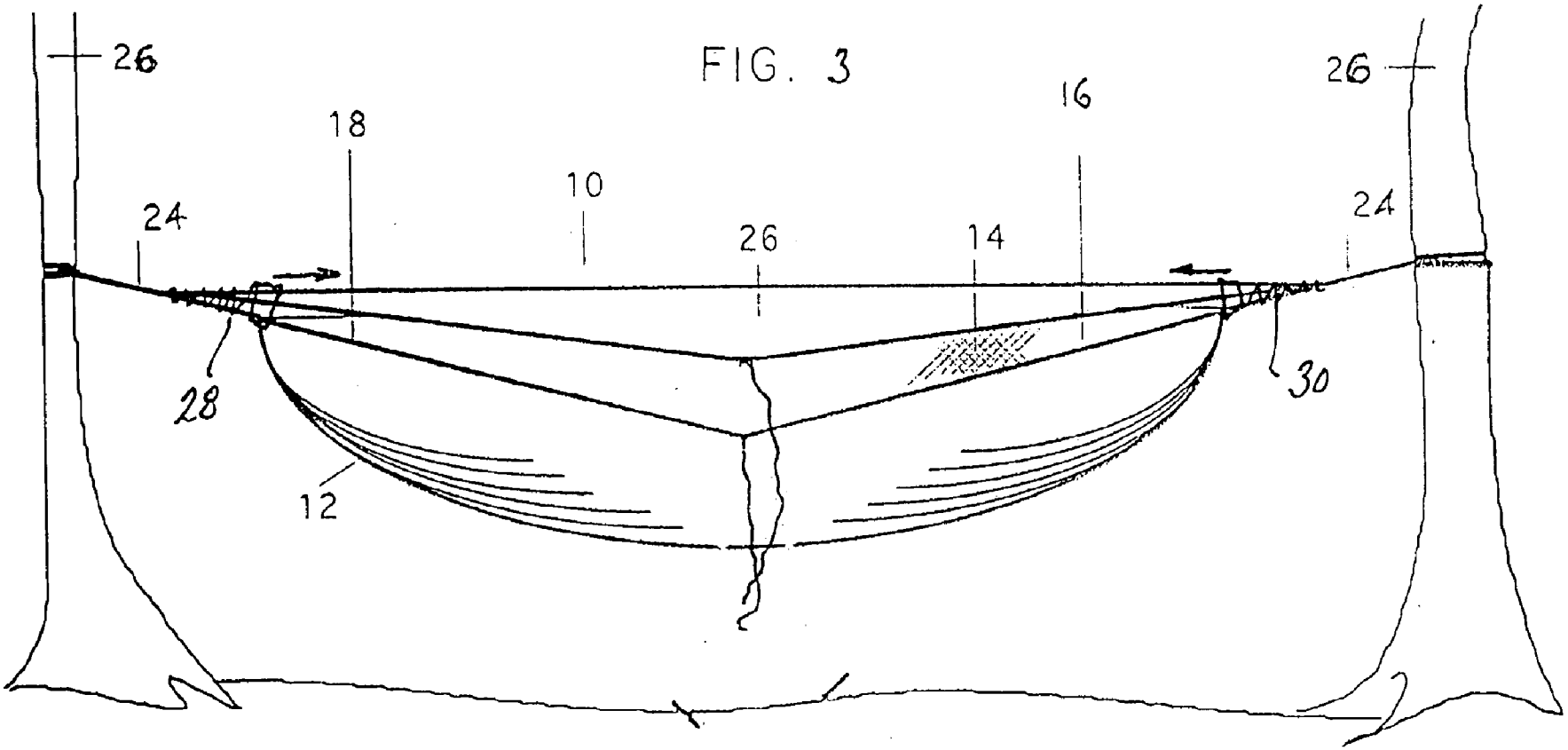
FIG. 3 shows the sheaths being drawn over the hammock.

In FIG. 3, the side ropes have been released, so that the sheaths can be drawn over the bed material. The start of the drawing operation is shown.

Figure 4:
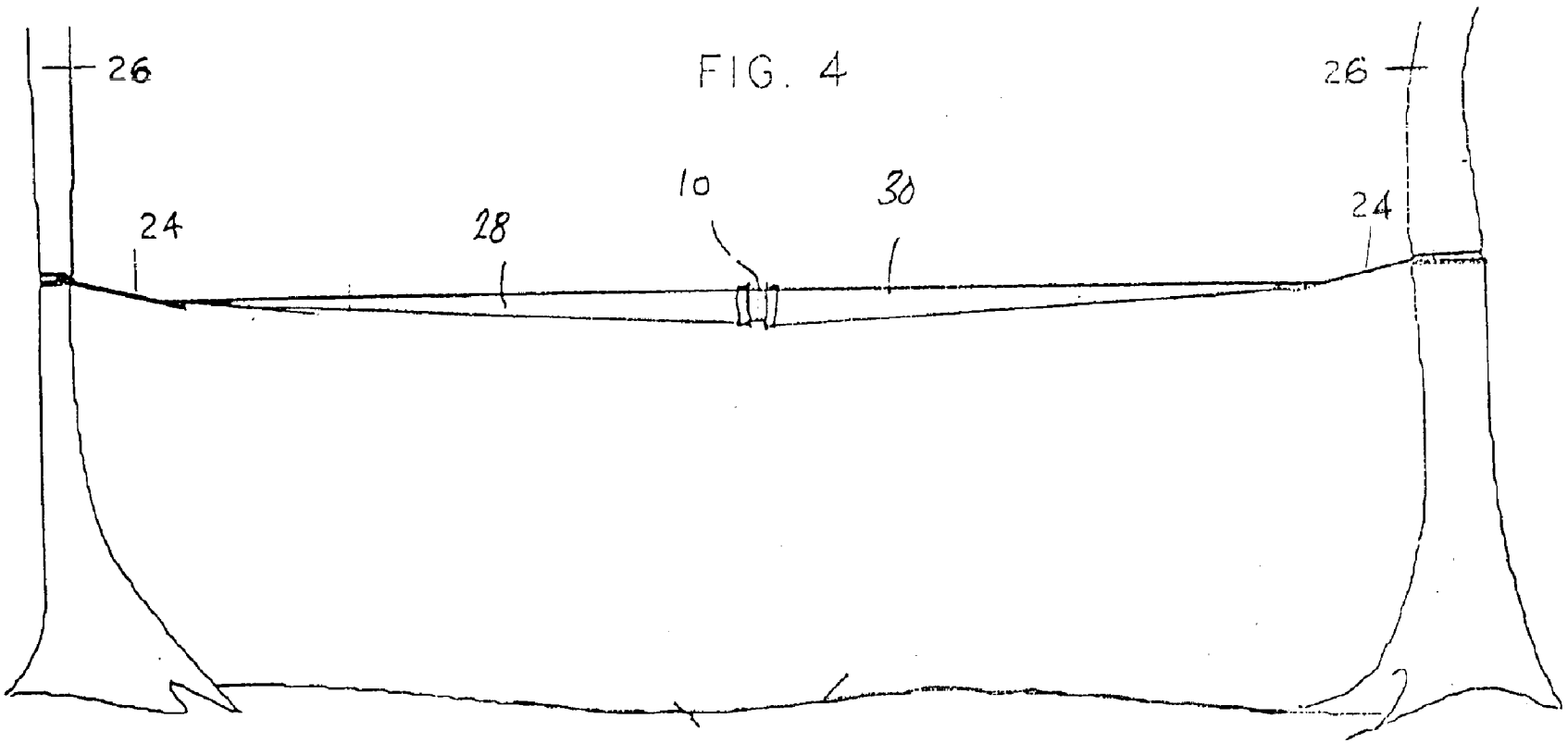
FIG. 4 shows the sheaths fully drawn and containing the bed, the insect net, and the canopy.

In FIG. 4, the sheaths have been fully drawn over the bed, meeting at the midpoint of the bed. Preferably, each sheath is about half as long as the bed material, so that the sheaths are fully extended when they meet.

Figure 5:
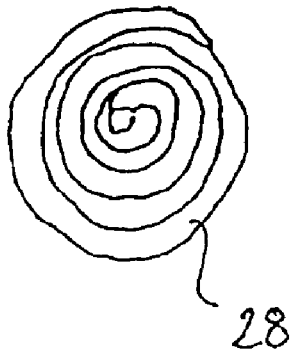
FIG. 5 shows the hammock, in the sheaths, rolled up for storage.

FIG. 5 shows the hammock, still in the sheath, rolled up for storage.

The sheath is preferably made of a low-friction material so that it does not drag unduly on the bed fabric material while it is being drawn. I prefer a nylon or polyurethane fabric for this reason. Currently, I most prefer a 30-dernier, 1.1 oz. silicone-impregnated nylon fabric because it draws easily over the hammock and has good water resistance.

Figure 6:
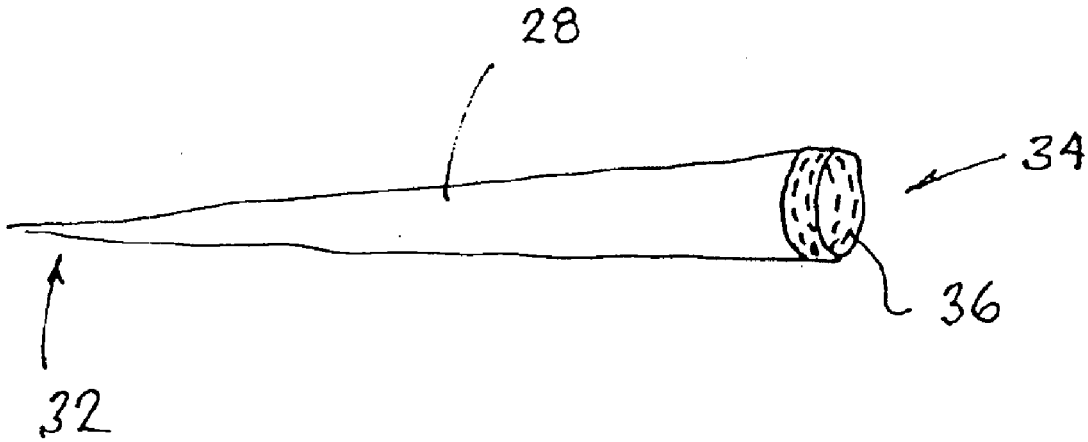
FIG. 6 shows the sheath in detail.

One sheath is shown in detail in FIG. 6. Here the sheath can be seen to taper, having a narrow closed end 32 and a wider open end or mouth 34 which is held open by a stiffener 36 inserted into the binding at the free end of the sheath. The stiffener makes it easier to grasp the mouth and draw it along the hammock. I presently prefer to form the stiffener from a polyethylene strip like that of a common cable tie. Other constructions, including closed rings. might be used instead. What is important is that the stiffener keep the mouth substantially open, and provide something to grasp with the fingers when sliding the sheath over the hammock.

The foregoing description has the narrow end 32 of each sheath connected to a respective end of the hammock's bed, over both the bed and the rain fly, so that both the bed and the fly are encased by drawing the sheaths. It is possible, however, to mount the sheath around the bed only, or around the fly only, so that one can be collapsed while the other remains free. Or separate sheaths might be provided: one for the bed and one for the rain fly.

While I prefer to have opposed sheaths as described and shown, it is possible to practice the invention with a single sheath which is as long as the bed, in which case the mouth of the sheath is drawn the full length of the bed, from one end to the other.

Since the invention is subject to modifications and variations, it is intended that the foregoing description and the accompanying drawings shall be interpreted as only illustrative of the invention defined by the following claims.

I claim:

1. A collapsible hammock having a flexible bed portion in combination with at least one sheath comprising a generally tubular piece of flexible material adapted to be drawn lengthwise over a substantial portion of the bed portion from a suspended end thereof and having a sufficiently small diameter over its entire length to collapse the bed portion within said sheath while the hammock is suspended between anchors.

2. The invention of claim 1, wherein each of said sheaths is made of a low-friction fabric material so as not to drag unduly on the bed portion while it is being drawn over the bed portion.

3. A collapsible hammock having a flexible bed portion, in combination with a pair of sheaths, each sheath comprising a generally tubular piece of flexible material adapted to be drawn lengthwise over the bed portion from a respective suspended end of the bed portion and having a sufficiently small diameter over its entire length to collapse the bed portion within said sheath while the hammock is suspended between anchors.

4. The invention of claim 3, wherein each of said sheaths has a length about half that of said bed portion, and an end of each of the sheaths is engaged at a respective end of the bed portion, whereby said sheaths, when fully drawn toward one another, meet at the midpoint of the bed portion.

5. The invention of claim 3, wherein each of the sheaths has a mouth and a stiffener secured to the sheath and extending around the mouth.

6. The invention of claim 5, further comprising a binding defining the mouth.

7. The invention of claim 6, wherein the stiffener is a polyethylene strip sewn into the binding.

8. The invention of claim 5, wherein the stiffener is a substantially rigid ring.

9. The invention of claim 3, wherein each of said sheath is made of a low-friction fabric material so as not to drag unduly on the bed portion while it is being drawn over the bed portion.

* * * * *